US006409565B1

(12) United States Patent
Itoh et al.

(10) Patent No.: US 6,409,565 B1
(45) Date of Patent: Jun. 25, 2002

(54) REDUCED VOLTAGE FIELD EMISSION CATHODE AND METHOD FOR MANUFACTURING SAME

(75) Inventors: Shigeo Itoh, Mobara; Junji Itoh; Seigo Kanemaru, both of Tsukuba, all of (JP)

(73) Assignees: Futaba Denshi Kogyo Kabushiki Kaisha, Mobara; Director General Agency of Industrial Science and Technology, Ministry of International Trade & Industry, Tokyo, both of (JP)

( * ) Notice: Subject to any disclaimer, the term of this patent is extended or adjusted under 35 U.S.C. 154(b) by 0 days.

(21) Appl. No.: 09/317,864

(22) Filed: May 25, 1999

(30) Foreign Application Priority Data

May 16, 1998 (JP) ..... 10-157480

(51) Int. Cl.[7] ..... H01J 9/00

(52) U.S. Cl. ..... 445/24

(58) Field of Search ..... 445/24, 50, 35, 445/51, 49; 430/396; 313/495, 496, 497, 309

(56) References Cited

U.S. PATENT DOCUMENTS 5,713,775 A * 2/1998 Geis et al. ..... 445/35
6,030,266 A * 2/2000 Ida et al. ..... 445/24

* cited by examiner

*Primary Examiner*—Michael H. Day
*Assistant Examiner*—Joseph Williams
(74) *Attorney, Agent, or Firm*—Oblon, Spivak, McClelland, Maier & Neustadt, P.C.

(57) ABSTRACT

A field emission cathode capable of emitting electrons under a low voltage. Lead-out electrodes are formed on an insulating layer and openings are formed at a lamination between the insulating layer and each of the lead-out electrodes. Emitters each are arranged in each of the openings. The insulating layer is provided on a lower surface thereof with a photoresist layer modified by heating. The modified photoresist layer is electrically connected through a resistive layer to a cathode electrode. The cathode electrode is formed in a pattern on a cathode substrate made of glass or the like. The emitters each are constituted by a distal end of each of projections of the modified photoresist layer exposed from the insulating layer. The photoresist is modified by heating, resulting in being provided with electrical conductivity and exhibiting stable electron emitting characteristics under a low voltage.

4 Claims, 3 Drawing Sheets

REDUCED VOLTAGE FIELD EMISSION CATHODE AND METHOD FOR MANUFACTURING SAME

BACKGROUND OF THE INVENTION

This invention relates to a field emission cathode and a method for manufacturing the same, and more particularly to a field emission cathode used as an electron source for a display unit, an image-pickup unit, a high-frequency device or the like and a method for manufacturing the same.

When an electric field of a level as high as about $10^9$ (V/m) is applied to a surface of a metal material or that of a semiconductor material, a tunnel effect occurs to permit electrons to pass through a barrier, resulting in the electrons being discharged to a vacuum atmosphere even at a normal temperature. Such a phenomenon is referred to as "field emission" and a cathode constructed so as to emit electrons based on such a principle is referred to as "field emission cathode".

One of conventional field emission cathodes which have been known in the art is of the Spindt type, which includes emitters each formed of metal such as molybdenum (Mo) or the like into a chip of a cone-like shape, as well as gate electrodes. An electric field of a low level is applied between the gate electrodes in proximity to the emitters to permit the emitters to emit electrons. Unfortunately, the field emission cathode of the Spindt type requires to deposit a high-melting metal material such as Mo or the like by electron beam (EB) deposition and bore holes in the gate electrodes (lead-out electrodes) and an insulating layer, to thereby cause an increase in manufacturing cost of the field emission cathode, resulting in mass-production of the field emission cathode increased in size being rendered difficult.

It is known in the art that diamond-like carbon emits electrons in an electric field of a low level. There is known a field emission cathode utilizing such a phenomenon, which uses a photoresist material modified. More particularly, the photoresist material is formed with projections by means of a transfer mold and then heated, resulting in being modified. This permits the thus-modified photoresist material to be increased in carbon-carbon covalent bond, to thereby exhibit electrical conductivity. The carbon-carbon bond has diamond-like carbon which is increased in crystallization mixedly contained therein.

However, the transfer mold is made of a silicon wafer, resulting in being limited to a size of up to 12 inches. Also, the transfer mold is removed from the modified photoresist layer by etching, resulting in being restricted to only one-time use. Further, the conventional process or method using diamond-like carbon for the emitters fails to readily form the lead-out electrodes while keeping them in proximity to the emitters. Absence of the lead-out electrodes fails to permit an advantage of the diamond-like carbon such as low-voltage drive to be satisfactorily exhibited.

SUMMARY OF THE INVENTION

The present invention has been made in view of the foregoing disadvantage of the prior art.

Accordingly, it is an object of the present invention to provide a field emission cathode which is capable of emitting electrons under a reduced voltage.

It is another object of the present invention to provide a method for manufacturing a field emission cathode which is capable of providing a field emission cathode attaining the above-described object.

In accordance with one aspect of the present invention, a field emission cathode is provided. The field emission cathode includes an insulating layer, lead-out electrodes formed on the insulating layer, openings formed at a lamination between the insulating layer and each of the lead-out electrodes, emitters each arranged in each of the openings, a cathode electrode, and a modified photoresist layer arranged on a lower surface of the insulating layer and modified by heating. The cathode electrode is electrically connected to the photoresist layer. The photoresist layer has projections exposed from the insulating layer. The emitters each are constituted by a distal end of each of the projections of the photoresist layer.

In a preferred embodiment of the present invention, the field emission cathode further includes a resistive layer so arranged that the cathode electrode is electrically connected through the resistive layer to the modified photoresist layer.

In accordance with another aspect of the present invention, a method for manufacturing a field emission cathode is provided. The method includes the steps of forming a cathode electrode pattern on a cathode substrate, forming a photoresist layer, superposing an intaglio provided with recesses for formation of projections and coated thereon with a release agent on the photoresist layer, subjecting the photoresist layer to molding under a pressure while being heated, to thereby form the photoresist layer with the projections and modify the photoresist layer, peeling off the intaglio, subjecting a surface of the modified photoresist layer to etching, forming an insulating layer on the modified photoresist layer, forming a gate electrode pattern on the insulating layer, and subjecting a lamination between lead-out electrodes on the gate electrode pattern and the insulating layer, to thereby form the lamination with openings, wherein the projections of the photoresist layer each are exposed at a distal end thereof from a portion of the insulating layer positioned at each of the openings.

In a preferred embodiment of the present invention, the method further includes the step of forming a resistive layer pattern on the cathode electrode pattern, followed by formation of the photoresist layer pattern.

In accordance with this aspect of the present invention, method for manufacturing a field emission cathode is provided. The method includes the steps of forming a cathode electrode pattern on a cathode substrate, forming a photoresist layer on an intaglio formed with recesses for formation of projections and coated thereon with a release agent, superposing the cathode layer and intaglio on each other in a manner to render the cathode electrode pattern and photoresist layer opposite to each other, forming a photoresist layer, superposing an intaglio provided with recesses for formation of projections and coated thereon with a release agent on the photoresist layer, subjecting the photoresist layer to molding under a pressure while being heated, to thereby form the photoresist layer with the projections and modify the photoresist layer, peeling off the intaglio, subjecting a surface of the modified photoresist layer to etching, forming an insulating layer on the modified photoresist layer, forming a gate electrode pattern on the insulating layer, and subjecting a lamination between lead-out electrodes on the gate electrode pattern and the insulating layer, to thereby form the lamination with openings, wherein the projections of the photoresist layer each are exposed at a distal end thereof from a portion of the insulating layer positioned at each of the openings.

In a preferred embodiment of the present invention, the method further includes the steps of a resistive layer pattern on the cathode electrode pattern and superposing the cathode substrate and intaglio on each other in a manner to render the resistive layer pattern and photoresist layer opposite to each other. Such construction effectively prevents flowing an overcurrent and concentration of a current to any specific emitters.

Thus, the method of the present invention permits the field emission cathode capable of emitting electrons by merely applying a voltage of a low level between the lead-out electrodes and the projections to be readily manufactured at a reduced cost.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference characters designate like or corresponding parts throughout; wherein.

DETAILED DESCRIPTION OF THE PREFERRED EMBODIMENTS

Now, the present invention will be described hereinafter with reference to the accompanying drawings.

Figure 1:
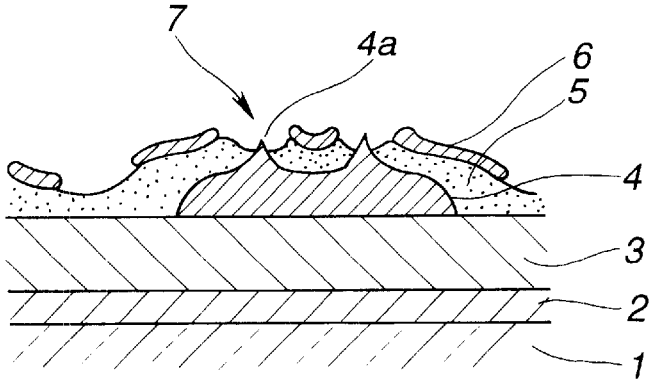
FIG. 1 is a fragmentary sectional view showing an embodiment of a field emission cathode according to the present invention.

Referring first to FIG. 1, an embodiment of a field emission cathode according to the present invention is illustrated. In FIG. 1, reference numeral 1 designates a cathode substrate, 2 is a cathode electrode, 3 is a resistive layer, 4 is modified photoresist layers, 4*a* is emitters, 5 is an insulating layer, 6 is lead-out electrodes, and 7 is openings.

The insulating layer 5 is formed thereon with the leadout electrode 6 and the opening 7 is provided at a lamination of the insulating layer 5 and lead-out electrode 6. The emitters 4*a* each are arranged in each of the openings 7. The insulating layer 5 is provided on a lower surface thereof with the modified photoresist layers 4 which are modified by heating. The modified photoresist layers 4 each are electrically connected through the resistive layer 3 to the cathode electrode 2. The cathode electrode 2 is formed in a pattern on the cathode substrate 1 made of glass or the like. The emitters 4*a* each are constituted by a distal end of each of projections of the modified photoresist layer 4 which is exposed from the insulating layer 5. The lead-out electrodes 6 constitute a part of a gate electrode pattern.

A photoresist is modified by heating, resulting in exhibiting electrical conductivity. A commercially available novolak resin photoresist commonly used for patterning during manufacturing of an IC may be used as a photoresist. Such commercially available photoresists include, for example, a photoresist manufactured under a tradename "OFPR-800 Type" by TOKYO OHKA KOGYO CO,. LTD. and the like. Heating of the photoresist causes oxygen and hydrogen atoms to be detached therefrom, leading to a reduction in thickness of the photoresist layer, resulting in being increased in carbon-carbon bond. Also, the photoresist layer 4 modified by heating contains a diamond-like carbon bond, to thereby exhibit stable electron emitting characteristics under a low voltage. When it is not required to carry out the patterning during manufacturing of the field emission cathode, a material mainly consisting of carbon may be laminated in place of the material for the photoresist layer. The substitute material is preferably in the form of liquid because such form facilitates application of the material.

In addition to the above-described construction of the illustrated embodiment that the emitter 4*a* is constituted by the modified photoresist, it is constructed so as to permit a distance between the lead-out electrode 6 and the emitter 4*a* to be reduced to a level below a micron, so that application of a voltage at a highly low level between the lead-out electrode 6 and the emitter 4*a* may permit the emitter 4*a* to emit electrons.

A structure for electrically connecting the emitter 4*a* and the cathode electrode 2 to each other may be constructed in any desired manner. The illustrated embodiment is so constructed that a current is fed from the emitter 4*a* to the cathode electrode 2 through the resistive layer 3 arranged on the cathode layer 2 and the modified photoresist layer 4 arranged on the resistive layer 3. Alternatively, the modified photoresist layer 4 may be superposed directly on the cathode electrode 2 without interposedly arranging the resistive layer 3 therebetween.

Substitutionally, the illustrated embodiment may be constructed in such a manner the cathode electrode 2 is formed into an island-like shape and the modified photoresist layer 4 and island-like cathode electrode 2 are electrically connected to a wiring section of a cathode electrode pattern. Alternatively, the illustrated embodiment may be so constructed that right under the modified photoresist layer 4, only the resistive layer 3 is formed on the cathode substrate 1 and the wiring section of the cathode electrode pattern is formed on another portion (not shown) of the modified photoresist layer 4, resulting in the modified photoresist layer 4 being connected through the resistive layer 3 to the wiring section of the cathode electrode pattern.

Formation of the resistive layer 3 between the cathode electrode 2 and the modified photoresist layer 4 is for the purpose of preventing flowing of an overcurrent during short-circuiting between the emitter 4*a* and the lead-out electrode 6 due to dust or the like, preventing flowing of an overcurrent during discharge between the emitter 4*a* and the lead-out electrode 6 or between the emitter 4*a* and the anode electrode due to degassing, and preventing concentration of a current to any specific emitter(s) 4*a*. Arrangement of the resistive layer 3 contributes to an increase in yields in manufacturing of the field emission cathode and stabilization of operation of the field emission cathode.

A gate electrode pattern includes the lead-out electrodes 6, each of which is formed with a plurality of openings 7. The single emitter 4*a* or an emitter array of one unit including a plurality of emitters 4*a* is arranged for every one of the lead-out electrodes 6 and connected to the cathode electrode 2 through the common resistive layer 3. When the field emission cathode of the illustrated embodiment is used as a filed emission cathode for a display device, a plurality of lead-out electrodes 6 are formed in correspondence to picture cells and the three primary colors on the single cathode substrate 1.

The gate electrode pattern and cathode electrode pattern are subject to matrix wiring, to thereby permit the emitter array or single emitter 4*a* belonging to any specific lead-out electrode on the cathode substrate 1 to be independently controlled as desired. For example, a plurality of cathode electrode lines are formed on the cathode substrate 1 and a plurality of gate electrode lines are formed on the insulating layer 5, so that the lines cooperate with each other to constitute a matrix. The cathode electrode lines each are formed on hundreds of emitters 4*a* arranged in a dot-like manner, so that the emitters 4*a* are selected depending on an input signal inputted to each of the lines on the cathode electrode 2 and application of a positive voltage to the gate electrode line connected to the lead-out electrode 6 perpendicular thereto.

Now, manufacturing of the field emission cathode thus constructed will be described with reference to the accompanying drawings. In FIG. 1, a pattern of the cathode electrode 2 is first formed on the cathode substrate 1 and then a pattern of the resistive layer 3 is formed on the cathode electrode 2, followed by formation of the photoresist layers 4. Apart from the above, an intaglio formed with recessed for formation of the projections is manufactured. The intaglio thus formed with the recesses and coated thereon with a release or parting agent is superposed on the photoresist layer and the photoresist layer is subject to molding under a pressure while being heated. This results in the photoresist layer being formed with the projections acting as the emitters 4*a* and modified. Thereafter, the intaglio is peeled off and a surface of the photoresist layer thus modified is subject to etching. Then, the modified photoresist layer is formed thereon with the insulating layer 5, which is then formed thereon with the gate electrode pattern. Subsequently, the lead-out electrodes 6 of the gate electrode pattern and laminations of the insulating layer 5 are subject to etching, resulting in the laminations each being formed with the openings 7, so that the projections of the modified photoresist layer 4 each may be exposed at a distal end thereof from a portion of the insulating layer 5 positioned at each of the openings 7.

Figure 2A:
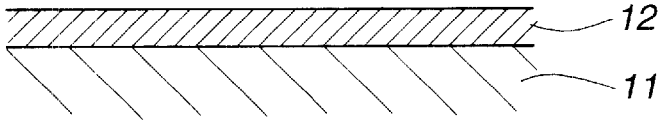
FIGS. 2(*a*) to 2(*c*) each are a schematic view showing a first step in a first embodiment of a method for manufacturing a field emission cathode according to the present invention.
Figure 2B:
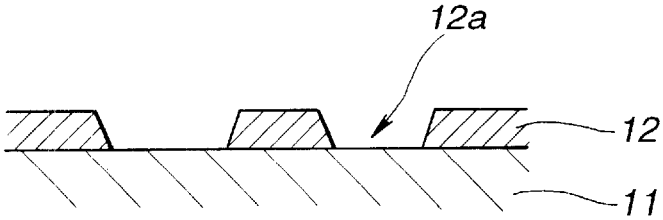
Figure 2C:
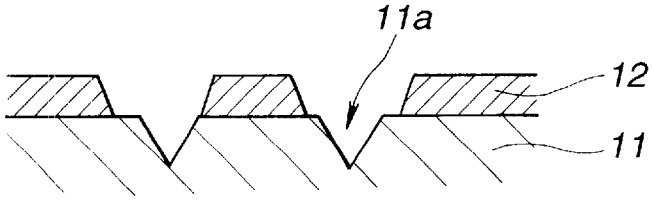
Figure 3:
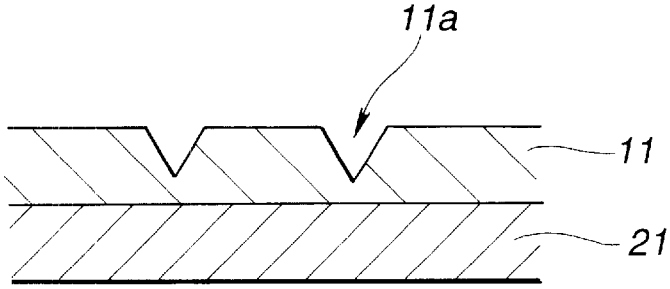
FIG. 3 is a schematic view showing a second step in a first embodiment of a method for manufacturing a field emission cathode according to the present invention.

Now, steps in the above-described manufacturing of the field emission cathode of the illustrated embodiment will be described with reference to FIGS. 2(*a*) to 7, wherein FIGS. 2(*a*) to 2(*c*) show a first step in a first embodiment of a method according to the present invention and FIG. 3 shows a second step in the first embodiment. The first and second steps are directed to manufacturing of the intaglio described above. In FIGS. 2(*a*) to 3, reference numeral 11 designates a silicon wafer, 11*a* is recesses, 12 is an oxide film, 12*a* is holes, and 21 is a metal substrate.

First, as shown in FIG. 2(*a*), the silicon wafer which is constituted by a silicon monocrystal is provided on a surface thereof with the oxide film 12, which is made of $SiO_2$ and formed into a thickness of 0.5 $\mu$m. Then, the oxide film 12 is formed thereon with the photoresist film (not shown) and the holes 12*a* of 1 $\mu$m to several $\mu$m in diameter are patterned at predetermined pitches as shown in FIG. 2(*b*). Subsequently, wet etching using BHF, dry etching using SF6 or CHF3, or the like is carried out while using the oxide film 12 as a mask layer, resulting in anisotropic etching being carried out.

This results in a plurality of such recesses 11*a* of a shape like an inverted quadrangular pyramid each surrounded by a (111) face which is a crystal structure of the silicon wafer 11 being formed. Then, the oxide film 12 acting as the mask layer is removed and then the silicon wafer 11 is laminated on the metal substrate 21 by means of an organic adhesive, resulting in the intaglio for stamping being provided as shown in FIG. 3. The intaglio using the silicon wafer 11 is joined onto the metal substrate 21 or the like so as to act as a base. This permits the intaglio to be repeatedly used by cleaning it and coating it with an oil release film by spraying, unless a main portion thereof is damaged or broken.

Figure 4:
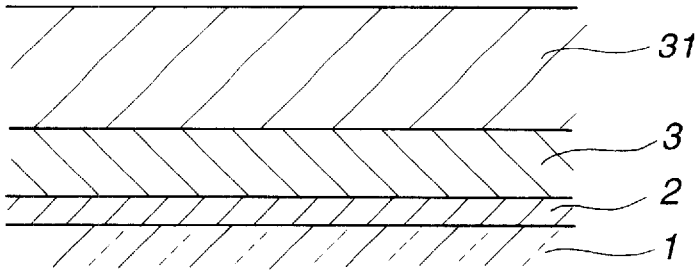
FIG. 4 is a schematic view showing a third step in a first embodiment of a method for manufacturing a field emission cathode according to the present invention.

FIG. 4 shows a third step in the first embodiment of the method according to the present invention, wherein reference numeral 31 designates a photoresist layer. The cathode substrate 1 made of glass is formed thereon with a pattern of the cathode electrode 2, which is then formed thereon with a pattern of a thick or thin film acting as the resistive layer 3. The thick or thin film pattern may be made of amorphous silicon (a-Si) or the like by patterning. Then, the thick or thin film pattern is coated thereon with a pattern of the photoresist layer 31 of about 10 $\mu$m in thickness and then subject to pre-baking at a temperature of about 100° C.

Figure 5:
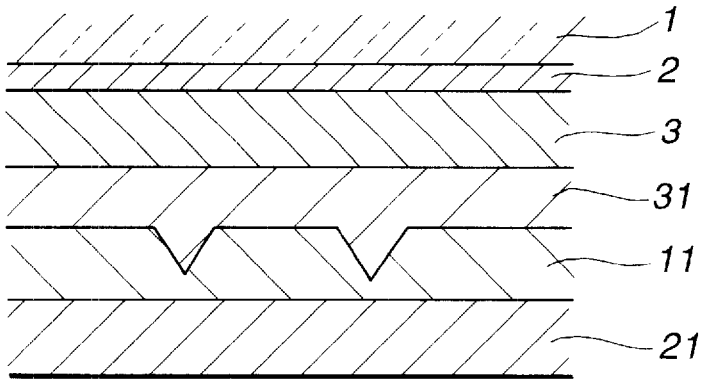
FIG. 5 is a schematic view showing a fourth step in a first embodiment of a method for manufacturing a field emission cathode according to the present invention.
Figure 6:
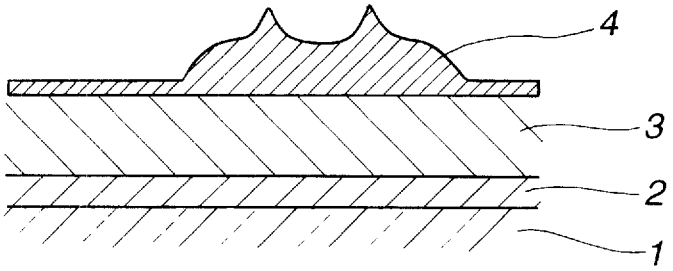
FIG. 6 is a schematic view showing a fifth step in a first embodiment of a method for manufacturing a field emission cathode according to the present invention.
Figure 7:
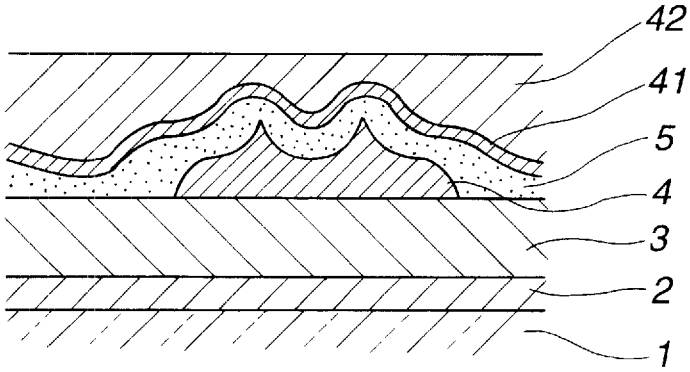
FIG. 7 is a schematic view showing a sixth step in a first embodiment of a method for manufacturing a field emission cathode according to the present invention.

FIGS. 5, 6 and 7 show fourth, fifth and sixth steps in the first embodiment of the method according to the present invention, respectively, wherein reference numeral 41 designates a metal film and 42 is a resist material.

A surface of the silicon wafer 11 of the intaglio shown in FIG. 3 is subject to washing and then coated thereon with a lubricant such as a silicone oil or the like acting as a parting or release agent by spraying, resulting in a stamp of the silicon wafer intaglio being provided. Then, a surface of the cathode substrate 1 (FIG. 4) facing the photoresist layer 31 is superposed on the stamp of the silicon wafer intaglio and pressurized in a vacuum or inert gas atmosphere while being superposed on the stamp. Such pressurization is carried out while heating the cathode substrate and stamp to a temperature of about 300 to 800° C. The photoresist layer 31 is modified by heating thus carried out, to thereby be increased in carbon-carbon bond, resulting in exhibiting electrical conductivity. Then, the intaglio and cathode substrate are released from each other, so that the modified photoresist layer 4 may be formed with the projections. Thereafter, a surface of the modified photoresist layer 4 is lightly subject to anisotropic etching by means of an $O_2$ asher or the like, to thereby remove the photoresist layer 4 other than the projections to the utmost.

Then, the insulating layer 5 is formed into a thickness of 0.4 to 1 $\mu$m on the photoresist layer 4 by suitable techniques such as plasma CVD, normal-pressure CVD, reduced-pressure CVD, hot filament CVD or the like. Also, the metal film 41 made of Nb or the like and acting as a gate electrode is formed into a thickness of 0.2 to 0.4 $\mu$m on the insulating layer 5 by sputtering deposition. Then, the metal film 41 is formed thereon with the resist material 42 in a manner to embed a distal end of each of projections of the metal film 41 therein, as shown in FIG. 7. For this purpose, the resist material 42 is formed into a thickness of 1 $\mu$m or more. The photoresist material may be either the same as the photoresist 31 or different therefrom.

In FIG. 7, the resist material 42 is etched by means of an $O_2$ asher or the like, so that the distal end of each of the projections of the metal film 41 may be exposed by a height of about 0.1 to 0.3 $\mu$m. Then, the exposed projections of the metal film 41 are subject to etching by dry etching using $SF_6$ or the like, resulting in the openings being formed. Further, wet etching using BHF or dry etching using $SF_6$ or $CHF_3$, or the like is carried out to selectively etch the insulating layer 5 arranged under the metal film 41 formed with the openings, to thereby expose the distal end of each of the projections of the modified photoresist layer 4, resulting in the field emission cathode shown in FIG. 1 being provided.

Now, a second embodiment of a method according to the present invention will be described hereinafter. In FIG. 1, a pattern of the cathode electrode 2 is formed on the cathode substrate 1. Also, apart from formation of the cathode electrode pattern, the intaglio which is provided with the recesses for formation of the projections and coated thereon with a release agent is formed thereon with a photoresist layer. Then, the cathode substrate and intaglio are superposed on each other while keeping the pattern of the cathode electrode 2 and the photoresist layer opposite to each other and then are subject to molded under a pressure while being heated, resulting in the photoresist layer being formed with the projections acting as the emitters 4*a* and concurrently modified. Then, the intaglio is peeled off and then the photoresist layer thus modified is subject on a surface thereof to etching. Thereafter, the insulating layer 5 may be formed on the modified photoresist layer and then a pattern of the gate electrode is formed on the insulating layer 5. Then, a lamination between the lead-out electrode 6 of the gate electrode pattern and the insulating layer 5 is subject to etching, to thereby form the lamination portion with the openings 7, resulting in the projections of the modified photoresist layer being exposed at the distal end thereof from a portion of the insulating layer positioned at each of the openings 7.

Figure 8:
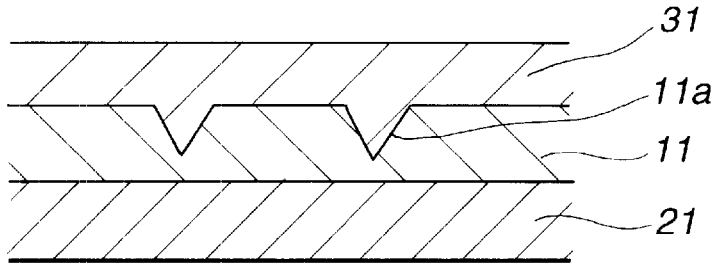
FIG. 8 is a schematic view showing a first step in a second embodiment of a method for manufacturing a field emission cathode according to the present invention.
Figure 9:
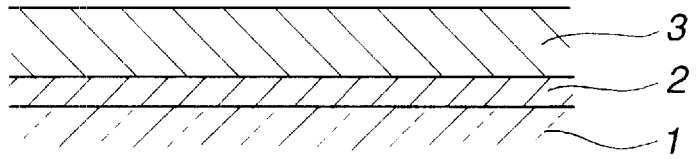
FIG. 9 is a schematic view showing a second step in a second embodiment of a method for manufacturing a field emission cathode according to the present invention.

FIG. 8 shows a first step in the second embodiment of the process of the present invention and FIG. 9 shows a second step in the second embodiment of the method of the present invention.

A release agent is coated on a surface of the intaglio of the silicon wafer 11 shown in FIG. 3 and then the photoresist 31 is formed thereon by spin coating, resulting in an intermediate product shown in FIG. 8 being obtained. The photoresist layer other than the photoresist material received in each of the recesses 11*a* is subject to etching by means of an $O_2$ asher or the like. Also, a pattern of the cathode electrode 2 is formed on the cathode substrate 1 made of glass as in FIG. 4 and then a pattern of a thick or thin film of amorphous silicon (a-Si) or the like is formed on the cathode electrode pattern so as to act as the resistive layer 3, resulting in another intermediate product shown in FIG. 9 being obtained.

Then, the photoresist 31 shown in FIG. 8 and the resistive layer 3 shown in FIG. 9 are superposed on each other while being aligned with each other. As in FIG. 5, both are pressurized in a vacuum or inert gas atmosphere while being heated to a temperature of about 300 to 800° C. and then subject to release, resulting in the modified photoresist layer being formed with the projections as shown in FIG. 6. The remaining procedure is carried out in substantially the same manner as in the above-described first embodiment of the method of the present invention. Thus, the insulating layer and metal layer are formed on the modified photoresist layer and the projections of the metal film are subject to etching, resulting in the openings being formed. Then, the insulating layer 5 is subject to etching, to thereby permit the distal end of each of the projections of the modified photoresist layer being exposed through each of the openings.

In each of the embodiments described above, the silicon wafer 11 is used as the intaglio. Alternatively, a material such as a monocrystal of a compound semiconductor or a metal film may be used as the intaglio, so long as it is possible to form the material with the recesses for formation of the projections on the photoresist layer 31.

As can be seen from the foregoing, the present invention permits a field emission cathode which exhibits increased electron emitting efficiency to be realized. Also, the method of the present invention permits a field emission cathode which exhibits increased electron emitting efficiency and satisfactory reproducibility, as well as homogeneity to be manufactured with a reduced cost. Thus, use of the field emission cathode of the present invention as a field emission cathode for a field emission display significantly increases variation of display and leads to a substantial reduction in manufacturing cost.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method for manufacturing a field emission cathode, comprising the steps of:

forming a cathode electrode pattern on a cathode substrate;

forming a photoresist layer;

superposing an intaglio provided with recesses for formation of projections and coated thereon with a release agent on the photoresist layer;

subjecting the photoresist layer to molding under a pressure while being heated, to thereby form the photoresist layer with the projections and modify the photoresist layer;

peeling off the intaglio;

subjecting a surface of the modified photoresist layer to etching;

forming an insulating layer on the modified photoresist layer;

forming a gate electrode pattern on the insulating layer; and subjecting a lamination between lead-out electrodes on the gate electrode pattern and the insulating layer, to thereby form the lamination with openings;

the projections of the photoresist layer each being exposed at a distal end thereof from a portion of the insulating layer positioned at each of the openings.

2. A method as defined in claim 1, further comprising the step of forming a resistive layer pattern on the cathode electrode pattern, followed by said formation of the photoresist layer pattern.

3. A method for manufacturing a field emission cathode, comprising the steps of:

forming a cathode electrode pattern on a cathode substrate;

forming a photoresist layer on an intaglio formed with recesses for formation of projections and coated thereon with a release agent;

superposing the cathode layer and intaglio on each other in a manner to render the cathode electrode pattern and photoresist layer opposite to each other;

forming a photoresist layer;

superposing an intaglio provided with recesses for formation of projections and coated thereon with a release agent on the photoresist layer;

subjecting the photoresist layer to molding under a pressure while being heated, to thereby form the photoresist layer with the projections and modify the photoresist layer;

peeling off the intaglio;

subjecting a surface of the modified photoresist layer to etching;

forming an insulating layer on the modified photoresist layer;

forming a gate electrode pattern on the insulating layer; and subjecting a lamination between lead-out electrodes on the gate electrode pattern and the insulating layer, to thereby form the lamination with openings;

the projections of the photoresist layer each being exposed at a distal end thereof from a portion of the insulating layer positioned at each of the openings.

4. A method as defined in claim 3, further comprising the step of a resistive layer pattern on the cathode electrode pattern; and superposing the cathode substrate and intaglio on each other in a manner to render the resistive layer pattern and photoresist layer opposite to each other.

* * * * *

UNITED STATES PATENT AND TRADEMARK OFFICE

CERTIFICATE OF CORRECTION

PATENT NO. : 6,409,565 B1
DATED : June 25, 2002
INVENTOR(S) : Itoh et al.

It is certified that error appears in the above-identified patent and that said Letters Patent is hereby corrected as shown below:

Title page,
Item [30], Foreign Applications Priority Data should read:

-- [30] Foreign Application Priority Data

June 5, 1998 (JP) …….10-157480 --

Signed and Sealed this

Twenty-eighth Day of January, 2003

JAMES E. ROGAN
*Director of the United States Patent and Trademark Office*